US009493969B2

(12) United States Patent
Park et al.

(10) Patent No.: US 9,493,969 B2
(45) Date of Patent: Nov. 15, 2016

(54) OUTSIDE DOOR HANDLE DEVICE FOR VEHICLE

(71) Applicant: Hyundai Motor Company, Seoul (KR)

(72) Inventors: Hoo Sang Park, Whasung-Si (KR); Jung Ho Han, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 144 days.

(21) Appl. No.: 14/452,142

(22) Filed: Aug. 5, 2014

(65) Prior Publication Data

US 2015/0167361 A1 Jun. 18, 2015

(30) Foreign Application Priority Data

Dec. 17, 2013 (KR) ..... 10-2013-0156976

(51) Int. Cl.
*E05B 3/00* (2006.01)
*E05B 85/16* (2014.01)
*E05B 77/06* (2014.01)

(52) U.S. Cl.
CPC ..... *E05B 85/16* (2013.01); *E05B 77/06* (2013.01); *Y10T 292/57* (2015.04)

(58) Field of Classification Search
CPC ..... Y10T 292/57; Y10T 292/0908; Y10T 70/5469; Y10T 70/5473; E05B 77/06; E05B 77/04; E05B 77/12; Y10S 292/22; Y10S 292/65; Y10S 292/26
USPC ..... 292/336.3, DIG. 22
See application file for complete search history.

(56) References Cited

U.S. PATENT DOCUMENTS

2008/0136199 A1* 6/2008 Kim ..... E05B 77/06 292/340
2008/0277948 A1* 11/2008 Takaya ..... E05B 85/16 292/336.3

FOREIGN PATENT DOCUMENTS

| | | | |
|---|---|---|---|
| JP | 2001-303804 | A | 10/2001 |
| KR | 10-2010-0060534 | A | 6/2010 |
| KR | 10-2012-0036700 | A | 4/2012 |
| KR | 10-2012-0047056 | A | 5/2012 |
| KR | 10-2013-0060869 | A | 6/2013 |

* cited by examiner

*Primary Examiner* — Mark Williams
(74) *Attorney, Agent, or Firm* — Morgan, Lewis & Bockius LLP

(57) ABSTRACT

An outside door handle device for a vehicle may include a handle base having a hinge hole and a lever hole on opposite sides thereof, respectively, and having a shaft coupling part and a slider groove on the side of the lever hole, a door handle having, on opposite sides thereof, respectively, a handle hinge to be inserted into the hinge hole and a handle lever to be inserted into the lever hole, a slider slidably mounted along the slider groove and coupled with the handle lever when the handle lever may be inserted into the lever hole, and a balance weight having a balance shaft to be rotatably inserted into the shaft coupling part and a balance lever to which an operation force of the door handle may be selectively transmitted.

7 Claims, 9 Drawing Sheets

OUTSIDE DOOR HANDLE DEVICE FOR VEHICLE

CROSS-REFERENCE(S) TO RELATED APPLICATION

The present application claims priority of Korean Patent Application Number 10-2013-0156976 filed on Dec. 17, 2013, the entire contents of which application is incorporated herein for all purposes by this reference.

BACKGROUND OF THE INVENTION

1. Field of the Invention

The present invention relates, in general, to an outside door handle device for a vehicle and, more particularly, to an outside door handle device for a vehicle, which has a reduced number of parts so as to obtain weight-reduction and cost-saving, as well as providing an easy assembly between a door handle, a handle base, and a balance weight.

2. Description of Related Art

Generally, an outside door handle device for a vehicle is a door latch device that is used by a user to open a door from outside of a vehicle. As shown in FIGS. 1, 2A and 2B, such an outside door handle device includes a handle base 1 fixedly mounted to a door panel, a base lever 3 which is rotatably coupled at one side thereof to the handle base 1 by means of a stationary shaft 2, a door handle which is rotatably fitted into the stationary shaft 2 at a handle hinge 4*a* on one side thereof, and is fitted into a mounting screw 3*a* of the base lever 3 at a handle lever 4*b* on the other side thereof, and a balance weight 8 which is elastically rotatably coupled to the handle base 1 via a balance shaft 5 and a torsion spring 6 while being connected with a door latch via a cable 7, such that, when the base lever 3 rotates, the balance weight rotates about the balance shaft 5 so as to actuate the door latch through the cable 7.

Thus, according to the conventional structure, when a user unlocks the door handle device and pulls the door handle 4, the door handle 4 rotates about the handle hinge 4*a* coupled to the stationary shaft 2 so that the handle lever 4*b* draws the base lever 3. Then, the base lever 3 rotates about the stationary shaft 2 so as to rotate the balance weight 8 to cause the cable 7 to be drawn and thus the door latch to be actuated, thereby opening the door of a vehicle.

However, such a conventional outside door handle device has a drawback in that, since the device is configured such that the operation of the door handle 4 does not directly actuate the balance weight 8, which actuates the door latch, but via the base lever 3, so that the manipulation force of the door handle 4 is transmitted to the balance weight 8 through the base lever 3, operative responsiveness of the balance weight 8 is not good when the door handle is manipulated.

Further, the use of the base lever 3 problematically increases the number and weight of parts as well as the manufacturing cost.

Further, the conventional structure is such that the handle lever 4*b* of the door handle 4 is coupled with the mounting screw 3*a* of the base lever 3 within a narrow working space, so that it is inconvenient to perform an assembly process.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an outside door handle device for a vehicle in which the operation of a door handle directly actuates a balance weight which actuates a door latch, without using a conventional base lever, thereby improving operative responsiveness of the balance weight, reducing the number of parts and therefore the weight and manufacturing cost of a product, and facilitating the assembly of parts, particularly a door handle, a handle base, and a balance weight.

In an aspect of the present invention, an outside door handle device for a vehicle, may include a handle base having a hinge hole and a lever hole on opposite sides thereof, respectively, and having a shaft coupling part and a slider groove on the side of the lever hole, a door handle having, on opposite sides thereof, respectively, a handle hinge to be inserted into the hinge hole and a handle lever to be inserted into the lever hole, a slider slidably mounted along the slider groove and coupled with the handle lever when the handle lever is inserted into the lever hole, and a balance weight having a balance shaft to be rotatably inserted into the shaft coupling part and a balance lever to which an operation force of the door handle is selectively transmitted.

The outside door handle device may further include a balance spring which is fixed to the handle base and the balance shaft at opposite sides thereof, respectively, to provide a restoration force to the balance weight when rotated.

The shaft coupling part of the handle base is provided with a shaft hole into which the balance shaft is rotatably inserted, and a support is provided, facing the shaft coupling part, at a position opposite the hinge hole on the handle base so as to support an end of the balance shaft.

The handle lever is provided with opposite lever protrusions protruding from opposite sides of a handle lever body along a longitudinal direction thereof so as to engage with the slider.

The handle lever is provided, at an end side thereof, with a bent part facing the handle hinge, and a balance lever-insertion groove is formed adjacent the bent part for an engagement with the balance lever, while opening towards the handle hinge.

The slider is provided with a pair of slider protrusions protruding towards the hinge hole and bent in parallel, and the slider protrusions each may have an insertion recess along which the lever protrusion is inserted.

The slider is provided with an extension rod extending towards the hinge hole, and an end side of the extension rod may have a positioning bent part configured to come into contact with an end side of the balance lever which is not yet inserted into the balance lever-insertion groove, so as to determine an initial engaging position of the balance weight.

The handle base is provided, at a position adjoining the slider groove, with a stopper bar configured to come into contact with the bent part of the handle lever when the handle lever is inserted into the lever hole so that the lever protrusions are inserted into the insertion recesses, so as to restrict an insertion distance of the handle lever.

The door handle and the handle base are configured such that, upon assembly, when the door handle is moved towards the hinge hole, with the handle hinge inserted into the hinge hole and the handle lever inserted into the lever hole so that the bent part thereof comes into contact with the stopper bar, the slider is moved together with the door handle so that the end side of the balance lever escapes from the positioning bent part of the slider and at the same time, the balance lever is inserted into the balance lever-insertion grooves.

The slider is configured to be fixedly coupled with a door lock by an assembling member when being moved such that the balance lever is inserted into the balance lever-insertion groove.

According to various aspects of the present invention, the configuration of the outside door handle device for a vehicle is such that, upon assembly of the door handle with the handle base, the door handle and the balance weight can also be coupled together, thereby facilitating the assembly of parts and thus improving productivity, reducing the number of parts and therefore the weight and manufacturing cost of a product, and improving operative responsiveness of the balance weight when the door handle is operated.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
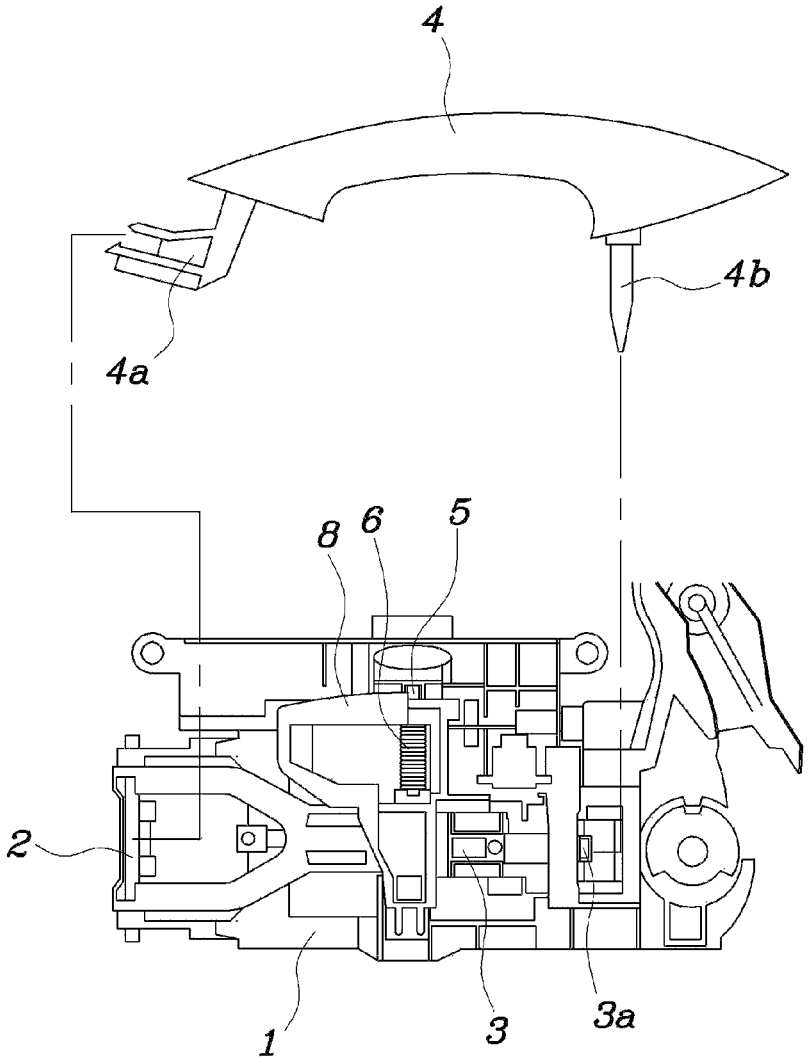
FIG. 1 (Prior Art)
FIGS. 1, 2A and 2B are views illustrating a conventional outside door handle device for a vehicle.
Figure 2A:
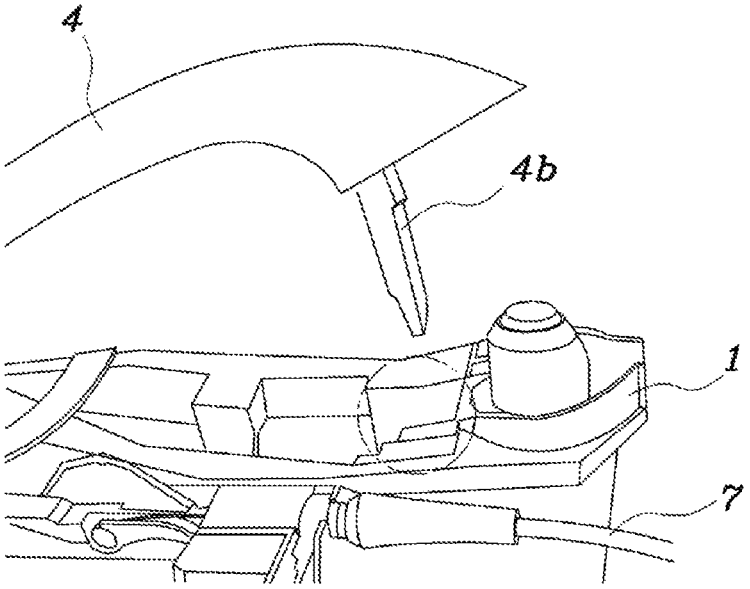
FIG. 2A (Prior Art)
Figure 2B:
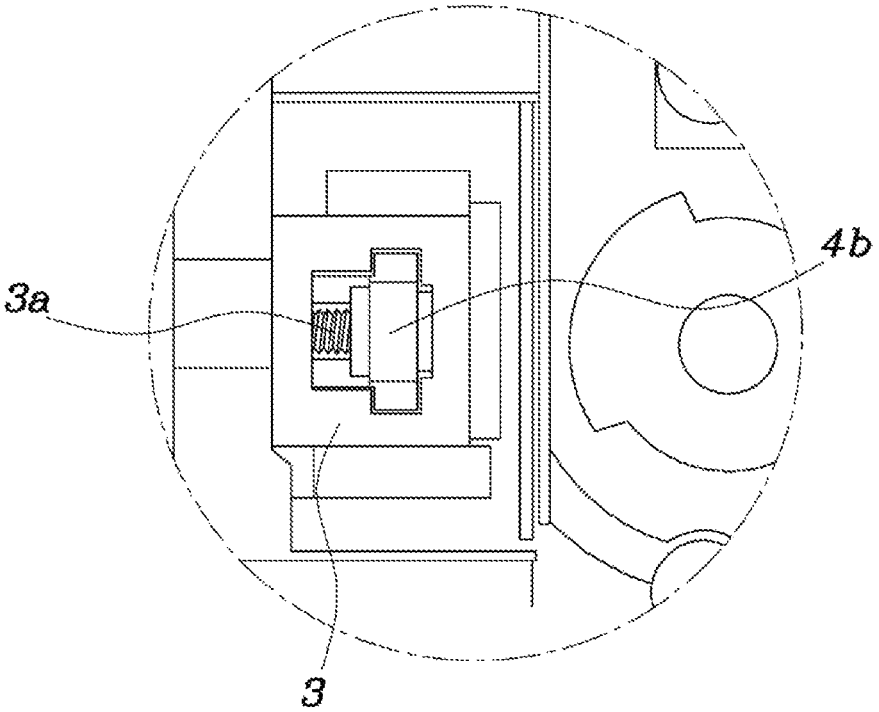
FIG. 2B (Prior Art)
Figure 3:
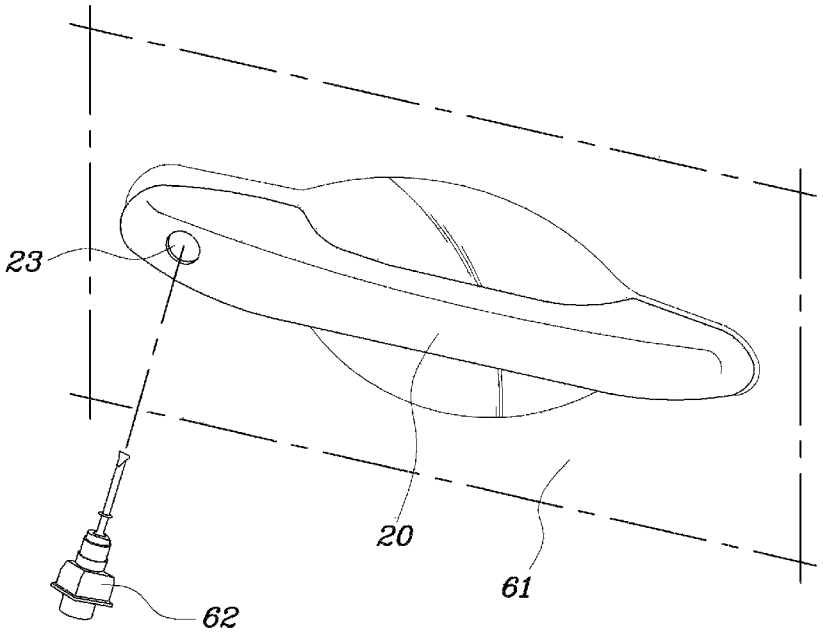
FIG. 3 is a perspective view illustrating an assembly of an outside door handle device for a vehicle according to an exemplary embodiment of the present invention.
Figure 4:
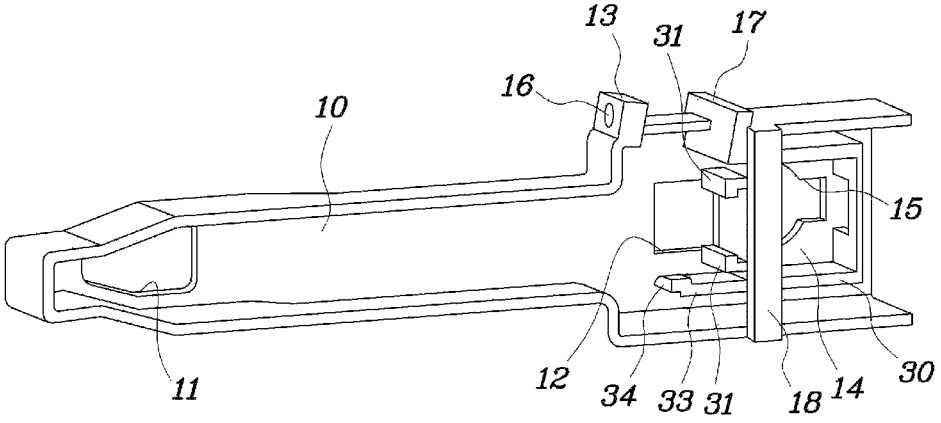
FIG. 4 is a view illustrating an assembly of a handle base and a slider according to an exemplary embodiment of the present invention.
Figure 5A:
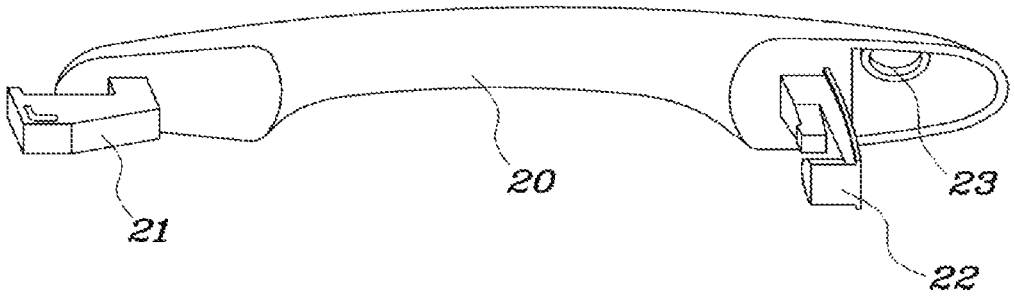
FIGS. 5A and 5B are perspective views illustrating a door handle according to an exemplary embodiment of the present invention.
Figure 5B:
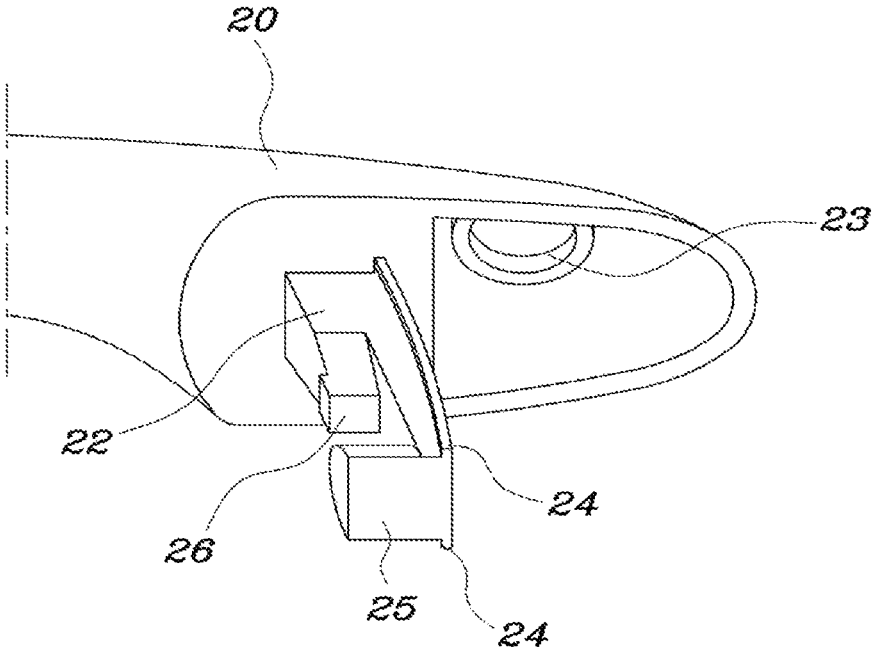
Figure 6A:
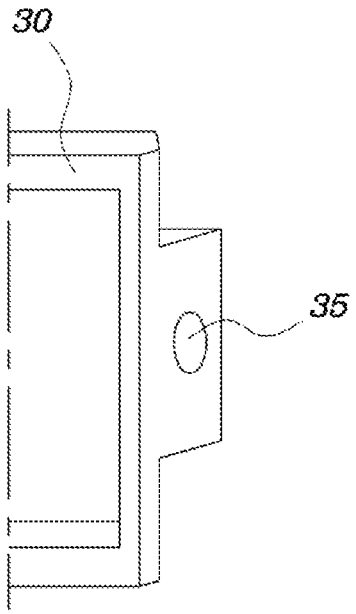
FIGS. 6A and 6B are perspective views illustrating a slider according to an exemplary embodiment of the present invention.
Figure 6B:
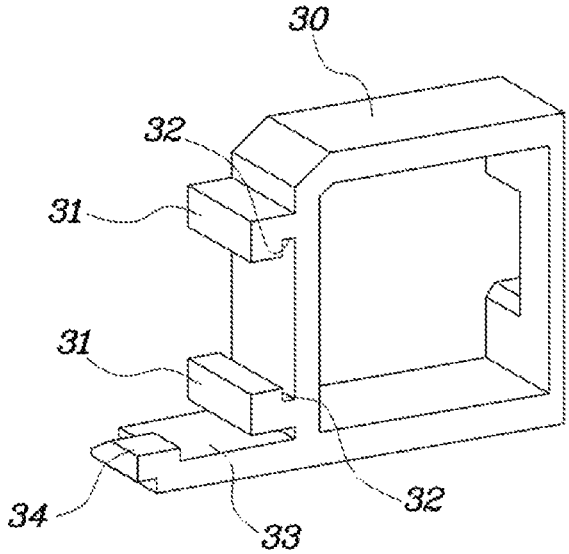
Figure 7:
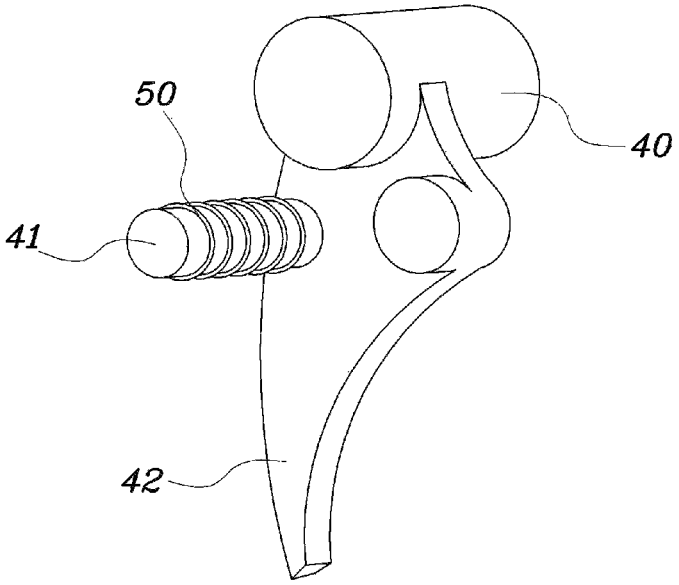
FIG. 7 is a perspective view illustrating a balance weight according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, an outside door handle device for a vehicle according to a preferred embodiment of the present invention will be described in detail with reference to the accompanying drawings.

As shown in FIGS. 3 to 12, the outside door handle device for a vehicle includes: a handle base 10 which has a hinge hole 11 and a lever hole 12 on opposite sides thereof, respectively, and has a shaft coupling part 13 and a slider groove 14 on the side of the lever hole 12, a door handle 20 which has, on opposite sides thereof, respectively, a handle hinge 21 to be inserted into the hinge hole 11 and a handle lever 22 to be inserted into the lever hole 12, a slider 30 which is to be mounted in such a manner as to be movable along the slider groove 14 and be coupled with the handle lever 22 when the handle lever 22 is inserted into the lever hole 12, and a balance weight 40 which has a balance shaft 41 to be rotatably inserted into the shaft coupling part 13 and a balance lever 42 to which an operation force of the door handle 20 is transmitted.

The outside door handle device further includes: a balance spring 50 which is fixed to the handle base 10 and the balance shaft 41 at opposite sides thereof, respectively, so as to provide a restoration force to the balance weight 40 when rotated.

Here, the handle base 10 is fixedly mounted to an inner side of an outer door panel 61, and the door handle 20 is mounted on an outer side of the outer door panel 61 in such a manner as to correspond to the handle base 10.

The door handle 20 and the handle base 10 have respective door lock holes 23 and 15 on sides of the handle lever 22 and the lever hole 12 in order to mount a door lock 62.

The shaft coupling part 13 of the handle base 10 is provided with a shaft hole 16 into which the balance shaft 41 is rotatably inserted, wherein a support 17 is provided, facing the shaft coupling part 13, at a position opposite the hinge hole 11 on the handle base 10 so as to support an end of the balance shaft 41.

The handle lever 22 of the door handle 20 is provided with opposite lever protrusions 24 which protrude from opposite sides of a body of the handle lever 22 along the longitudinal direction thereof so as to engage with the slider 30. The handle lever 22 is provided, at an end side thereof, with a bent part 25 facing the handle hinge 21, with a balance lever-insertion groove 26 formed adjacent the bent part 25 for the engagement with the balance lever 42, while opening towards the handle hinge 21.

The slider 30 is provided with a pair of slider protrusions 31 which protrude towards the hinge hole 11 and are bent in parallel when the slider 30 is inserted into the slider groove 14 of the handle base 10, wherein the slider protrusions 31 each have an insertion recess 32 along which the lever protrusion 24 is inserted.

The slider 30 is provided with an extension rod 33 extending towards the hinge hole 11 of the handle base 10, wherein an end side of the extension rod 33 has a positioning bent part 34 configured to come into contact with an end side of the balance lever 42 which is not yet inserted into the balance lever-insertion groove 26, so as to determine an initial engaging position of the balance weight 40.

That is, when the slider 30 is mounted into the slider groove 14 of the handle base 10, and the balance weight 40 is initially coupled with the handle base 10 such that one side of the balance shaft 41 is inserted into the shaft hole 16 of the shaft coupling part 13, whereas the outer side of the balance shaft is supported by the support 17, the end side of the balance lever 42 comes into contact with and abuts against the positioning bent part 34 of the slider 30, thereby determining an initial engaging position of the balance weight 40.

When the end side of the balance lever 42 comes into contact with and abuts against the positioning bent part 34 of the slider 30, the balance spring 50 becomes compressed, having an elastic restoration force therein.

The handle base 10 is integrally provided, at a position adjoining the slider groove 14, with a stopper bar 18 which is configured to come into contact with the bent part 25 of the handle lever 22 when the handle lever 22 is inserted into the lever hole 12 so that the lever protrusions 24 are inserted into the insertion recesses 32 of the slider 30, so as to restrict an insertion distance of the handle lever 22.

According to an exemplary embodiment of the present invention, the door handle 20 and the handle base 10 are configured such that, upon assembly, when the door handle 21 is moved towards the hinge hole 11, with the handle hinge 21 inserted into the hinge hole 11 and the handle lever 22 inserted into the lever hole 12 so that the bent part 25 thereof comes into contact with the stopper bar 18, the slider 30 is moved together with the door handle so that the end side of the balance lever 42 escapes from the positioning bent part 34 of the slider and at the same time, the balance lever 42 is inserted into the balance lever-insertion grooves 26.

The slider 30 is configured to be fixedly coupled with a door lock 62 by means of an assembling member 63 when being moved together with the door handle 20 such that the balance lever 42 is inserted into the lever-insertion groove 26.

The slider 30 is provided on one side with an assembly hole 35 for the engagement with the door lock 62.

The operation of the exemplary embodiment of the invention will now be described.

Figure 8A:
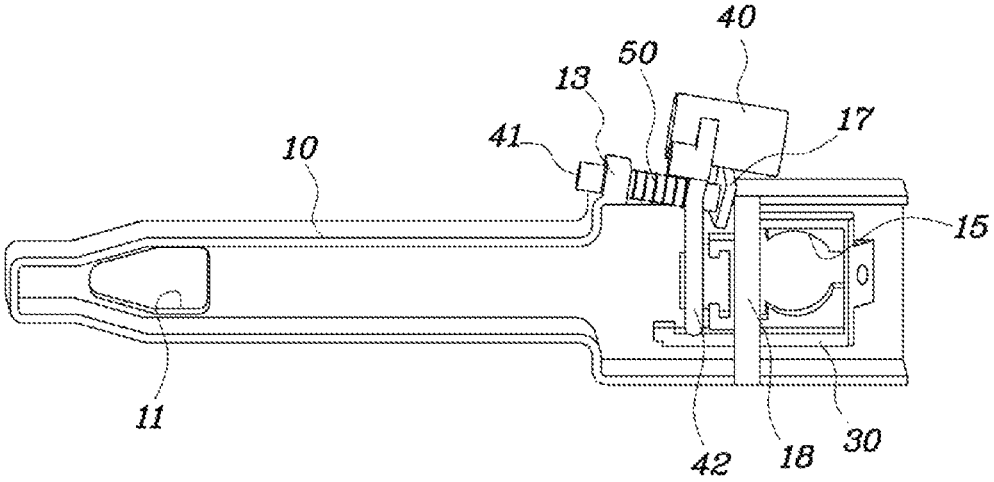
FIGS. 8A and 8B are views illustrating an initial assembly of the handle base, the slider and the balance weight according to an exemplary embodiment of the present invention.
Figure 8B:
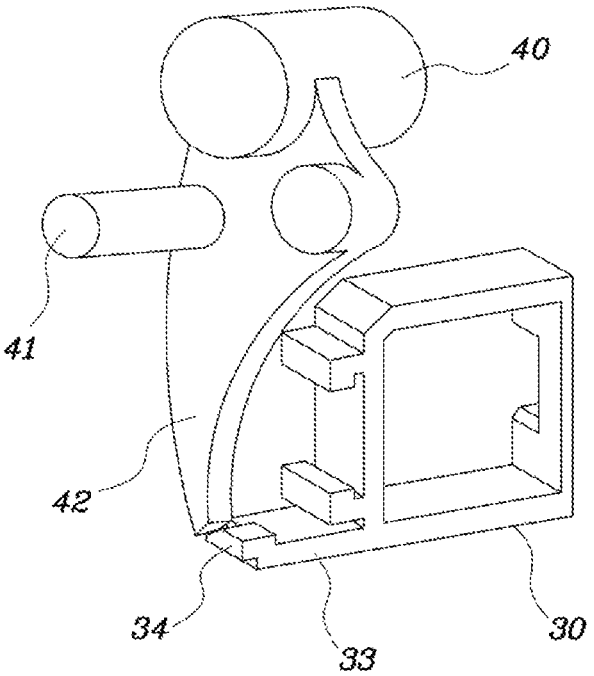

First, the handle base 10 is fixedly mounted on an inner side of an outer door panel 61, and the slider 30 is mounted into the slider groove 14 of the handle base 10 as shown in FIGS. 8A and 8B such that one side of the balance shaft 41 is inserted through the shaft hole 16 of the shaft coupling part 13, and the outer side of the balance shaft 41 is supported by the support 17.

Then, the end side of the balance lever 42 provided on the balance weight 40 comes into contact with and abuts against the positioning bent part 34 of the slider 30, so that an initial engaging position of the balance weight 40 can be determined.

When the end side of the balance lever 42 comes into contact with an abuts against the positioning bent part 34 of the slider 30 as such, so that the initial engaging position of the balance weight 40 is set, the balance spring 50 is in a compressed state, accumulating an elastic restoration force therein.

Figure 9:
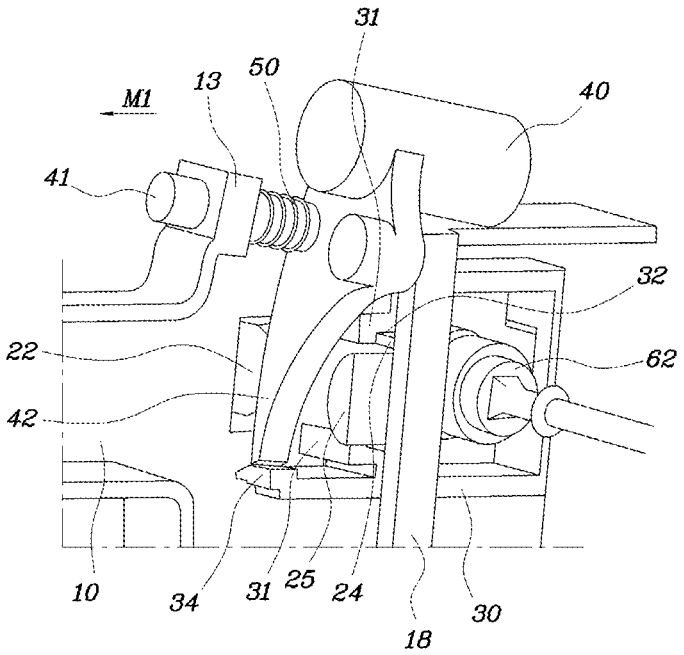
FIG. 9 is a view illustrating an assembly of a handle lever, the handle base, the slider, and the balance weight according to an exemplary embodiment of the present invention.
Figure 10:
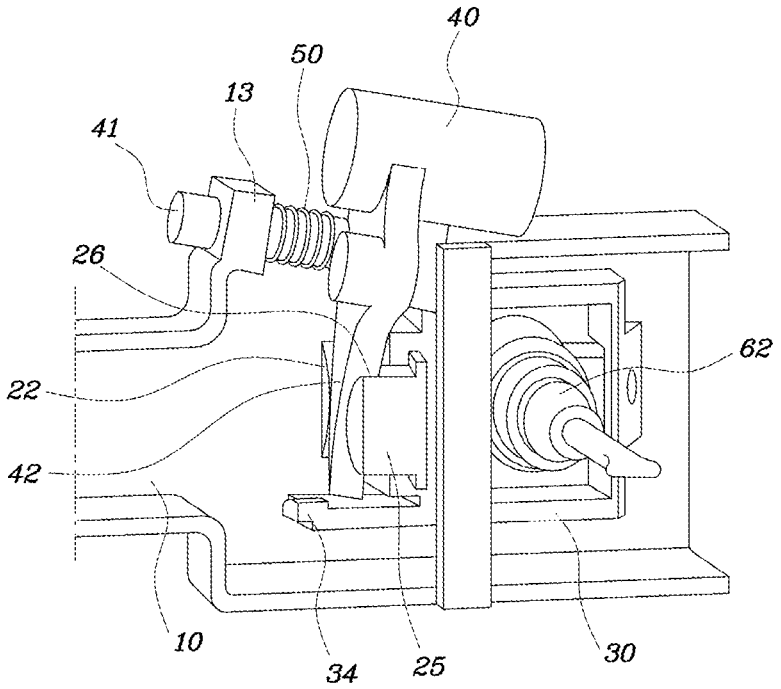
FIGS. 10 and 11 are views illustrating a final assembly of the handle lever, the handle base, the slider, and the balance weight.
Figure 11:
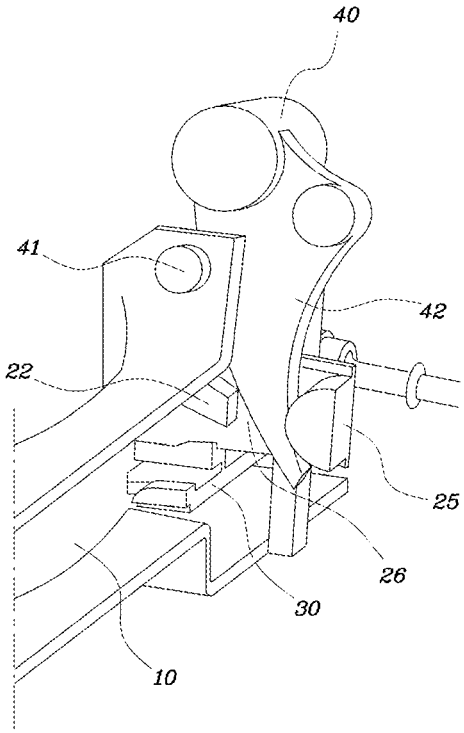
Figure 12:
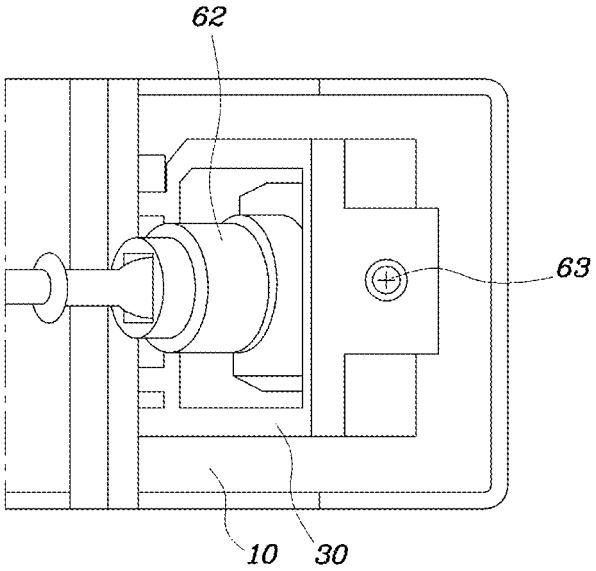
FIG. 12 is a view illustrating an assembly of the slider and a door lock.

When the assembly of the slider 30 and the balance weight 40 with the handle base 10 has been completed, the door lock 62 is mounted through the outer door panel 61 and the door lock hole 15 of the handle base 10, the handle hinge 21 of the door handle 20 is inserted into the hinge hole 11 of the handle base 10, and the handle lever 22 of the door handle 20 is inserted into the lever hole 12 of the handle base 10 as shown in FIG. 9.

The handle lever 22 is inserted into the lever hole 12 so that the lever protrusions 24 of the handle lever 22 are inserted into the insertion recesses 32 of the slider 30, and when the insertion of the handle lever is continued, the bent part 25 of the handle lever 22 comes into contact with the stopper bar 18, so that the handle lever 22 cannot be inserted any more.

When the bent part 25 is brought into contact with the stopper bar by the insertion of the handle lever 22, the door handle 20 is moved towards the hinge hole 11 (the direction of arrow M1 in FIG. 9) by a user. Here, the slider 30 is also moved together with the door handle 20 so that the end side of the balance lever 42 escape from the positioning bent part 34 and at the same time, the balance lever 42 is inserted into the lever-insertion groove 26 formed in the handle lever 22.

In the meantime, when the end side of the balance lever 42 escapes from the positioning bent part 34 due to the movement of the slider 30, the balance weight 40 is simultaneously subjected to an elastic restoration force from the compressed balance spring 50, and thus an axial rotation, so that the balance lever 42 elastically supports the handle lever 22 in a state of being inserted into the lever-insertion groove 26, thereby completing the assembly of the handle base 10, the door handle 20, the slider 30, and the balance weight 40.

Thus, when a user pulls the door handle 20, the door handle is pulled at a portion adjoining the handle lever 22 while rotating about the handle hinge 21 so that the operation force of the handle lever 22 is transmitted to the balance weight 40 through the balance lever 42. Thus, the balance weight 40 axially rotates about the balance shaft 41.

Such an axial rotation of the balance weight 40 allows a cable connected thereto to be drawn, so that a door latch is operated accordingly, thereby opening the outside door of a vehicle.

As set forth in the foregoing, according to the exemplary embodiment of the present invention, since the door handle 20 and the balance weight 40 are directly connected so that, upon the operation of the door handle 20, the balance weight 40 for actuating the door latch is directly operated, the operative responsiveness of the balance weight upon the operation of the door handle 20 can be improved, contributing to an improved quality of a product.

Further, since the configuration of the present invention can eliminate a base lever which is operated along with the door handle according to the related art, the number of parts, and the weight and cost of a product can be reduced.

Further, since the configuration of the present invention is such that, upon the assembly of the door handle 20 with the handle base 10, the door handle 20 and the balance weight 40 can also be assembled, therefore easy assembly and improved productivity of the outside door handle device can be obtained.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An outside door handle device for a vehicle, the outside door handle device comprising:

a handle base having a hinge hole and a lever hole on a first side and a second side thereof, respectively, and the handle base having a shaft coupling part and a slider groove on a side of the lever hole;

a door handle having, on a first side and a second side thereof, respectively, a handle hinge to be inserted into the hinge hole and a handle lever to be inserted into the lever hole;

a slider slidably mounted along the slider groove and coupled with the handle lever when the handle lever having a lever protrusion is inserted into the lever hole; and a balance weight having a balance shaft to be rotatably inserted into the shaft coupling part and a balance lever to which an operation force of the door handle is selectively transmitted, wherein the slider is provided with a pair of slider protrusions protruding towards the hinge hole and bent in parallel, wherein the slider protrusions each have an insertion recess along which the lever protrusion of the handle lever is inserted, wherein the slider is provided with an extension rod extending towards the hinge hole, wherein an end side of the extension rod has a positioning bent part configured to come into contact with an end side of the balance lever which is not yet inserted into the balance lever-insertion groove, so as to determine an initial engaging position of the balance weight, and wherein the door handle and the handle base are configured such that, upon assembly, when the door handle is moved towards the hinge hole, with the handle hinge inserted into the hinge hole and the handle lever inserted into the lever hole so that a bent part of the handle lever comes into contact with a stopper bar, the slider is moved together with the door handle so that the end side of the balance lever escapes from the positioning bent part of the slider and at the same time, the balance lever is inserted into the balance lever-insertion grooves.

2. The outside door handle device for the vehicle according to claim 1, further comprising:

a balance spring fixed to the handle base and the balance shaft at a first side and a second side thereof, respectively, to provide a restoration force to the balance weight when rotated.

3. The outside door handle device for the vehicle according to claim 1, wherein the shaft coupling part of the handle base is provided with a shaft hole into which the balance shaft is rotatably inserted, and wherein a support is provided, facing the shaft coupling part, at a position opposite the hinge hole on the handle base so as to support an end of the balance shaft.

4. The outside door handle device for the vehicle according to claim 1, wherein the handle lever is provided with opposite lever protrusions protruding from opposite sides of a handle lever body along a longitudinal direction thereof so as to engage with the slider.

5. The outside door handle device for the vehicle according to claim 4, wherein the handle lever is provided, at an end side thereof, with a bent part facing the handle hinge, and wherein a balance lever-insertion groove is formed adjacent the bent part for an engagement with the balance lever, while opening towards the handle hinge.

6. The outside door handle device for the vehicle according to claim 1, wherein the handle base is provided, at a position adjoining the slider groove, with the stopper bar configured to come into contact with the bent part of the handle lever when the handle lever is inserted into the lever hole so that the lever protrusions are inserted into the insertion recesses, so as to restrict an insertion distance of the handle lever.

7. The outside door handle device for the vehicle according to claim 1, wherein the slider is configured to be fixedly coupled with a door lock by an assembling member when being moved such that the balance lever is inserted into the balance lever-insertion groove.

* * * * *